United States Patent [19]

Groothuis

[11] 4,003,131

[45] Jan. 18, 1977

[54] DRY-SHAVING APPARATUS WITH RECIPROCATABLE CUTTING BLOCK

[75] Inventor: Gerrit Jan Groothuis, Drachten, Netherlands

[73] Assignee: U.S. Philips Corporation, New York, N.Y.

[22] Filed: Apr. 2, 1975

[21] Appl. No.: 564,226

[30] Foreign Application Priority Data

Apr. 5, 1974 Netherlands ..... 7404655

[52] U.S. Cl. ..... 30/43.92; 30/42

[51] Int. Cl.[2] ..... B26B 19/02

[58] Field of Search ..... 30/42, 43.91, 43.92, 30/210, 216, 272 A

[56] References Cited

UNITED STATES PATENTS

| | | | |
|---|---|---|---|
| 2,822,610 | 2/1958 | Kleinman | 30/43.92 X |
| 3,810,306 | 5/1974 | Locke | 30/43.92 |
| 3,858,314 | 1/1975 | Brenneman | 30/43.92 |

*Primary Examiner*—Gary L. Smith
*Attorney, Agent, or Firm*—Frank R. Trifari

[57] ABSTRACT

A dry-shaving apparatus with a thin elastic arcuated shear plate and a reciprocatable cutter, a drive pin of an electric motor fits in a coupling slot of the cutter with a resilient means urging said pin into firm engagement with said slot.

3 Claims, 4 Drawing Figures

DRY-SHAVING APPARATUS WITH RECIPROCATABLE CUTTING BLOCK

The invention relates to a dry-shaving apparatus which comprises a housing, an electric drive motor in the housing and coupled to a drive pin which projects from the housing, a thin elastic plate-shaped arcuated shear plate with hair-entrance apertures. A cutting block is pressed into the arcuation of the shear plate, which block is reciprocatable by the drive pin, has a multiplicity of cutting edges whose shape is in accordance with the arcuation and is provided with a frame with a coupling slot for coupling the cutting block to the drive pin. Resilient means are situated beside the coupling slot for elastically clamping the drive pin between the walls of the coupling slot.

Such a dry-shaving apparatus is known from Austrian Patent Specification No. 260,722, which relates to a dry-shaving apparatus in which the frame of the block comprises a plastic member which is provided with two integral resilient tags between which the drive pin of the motor is clamped. As the dry shaving apparatus of the present type has a stroke of a few millimetres only, it is of great importance that loss of the cutting block stroke during operation of the dry-shaving apparatus is minimized. A reduction of the stroke of the cutting block results in a proportional decrease of the number of hairs that can be shaved off per unit of time, so that the effectiveness of the dry-shaving apparatus is adversely affected by the stroke reduction. Loss of stroke may be the result of play of the drive pin between the walls of the coupling slot. In the prior-art constructions this problem is solved by clamping the drive pin between the edges of the coupling slot. Yet, a limited loss of stroke may occur owing to the elastic deformability of the previously mentioned tags. It is an object of the invention to provide a dry-shaving apparatus in which play between the drive pin and the walls of the coupling slot is prevented and in which less loss of stroke occurs. The invention is characterized in that the coupling slot is bounded at one side by a substantially rigid wall and that only the other wall is movable against the action of the resilient means.

In order to avoid overloading of the resilient means one embodiment is characterized in that the cutting block is provided with a stop for limiting the deflection of the resilient movable wall. A further embodiment is characterized in that the resilient movable wall is constituted by a leaf spring.

In many cases in which the frame of the cutting block consists of a material which is less suited for cooperation with the drive pin, a different embodiment is of interest, which is characterized in that the leaf spring consists of a tab which is cut out at three sides, which tab is integral with a coupling-slot lining which is made of a thin sheet material.

The invention will be described in more detail with reference to the drawing which shows a preferred embodiment of the invention.

BRIEF DESCRIPTION OF THE DRAWINGS

In the Figures corresponding components are denoted by corresponding reference numerals.

DETAILED DESCRIPTION OF THE PREFERRED EMBODIMENT

Figure 1:
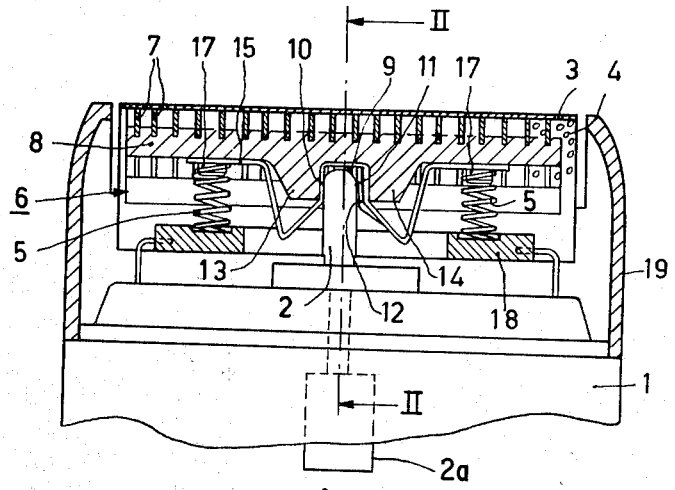
FIG. 1 is a longitudinal sectional view of the upper part of a dry-shaving apparatus.
Figure 2:
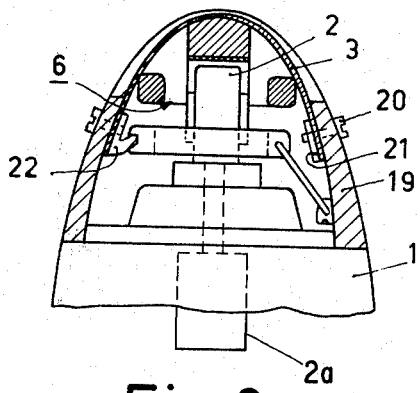
FIG. 2 is a sectional view taken along line II—II in FIG. 1.

The housing of the dry-shaving apparatus of FIGS. 1 and 2 is denoted by 1. An electric drive motor which is accommodated in said housing is represented symbolically by part 2a in the drawing, and in the present state of the art many motors are known which are suitable for the dry-shaving apparatus shown. Such a motor is capable of reciprocating the drive pin 2 which projects from the housing. The thin elastic arcuated shear plate designated 3 has a multiplicity of hair-entrance apertures 4. The pressure springs 5 press a cutting block or cutter assembly 6 into the arcuation of the shear plate 3. Assembly 6 comprises a number of lamellar cutters 7, whose cutting edges conform with the arcuated shape of the shear plate 3. The cutters are cast-in in an aluminium frame 8 which is provided with a coupling slot 9, which defines first and second spaced walls or sides, is at one side bounded by a substantially rigid wall 10, while the other side has a resiliently movable wall 11 which is constituted by a leaf spring or connection means 12. At one side of the coupling slot 9 the frame comprises projection 13 and, at the other side is projection 14 which serves as a stop for the leaf spring 12.

Figure 3:
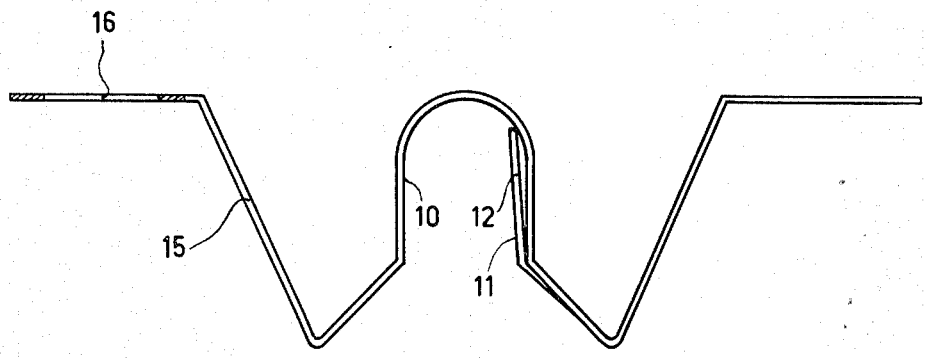
FIG. 3 is a side elevation of the component which is made of a sheet material which also forms the lining of the coupling slot of the dry-shaving apparatus of FIGS. 1 and 2.
Figure 4:
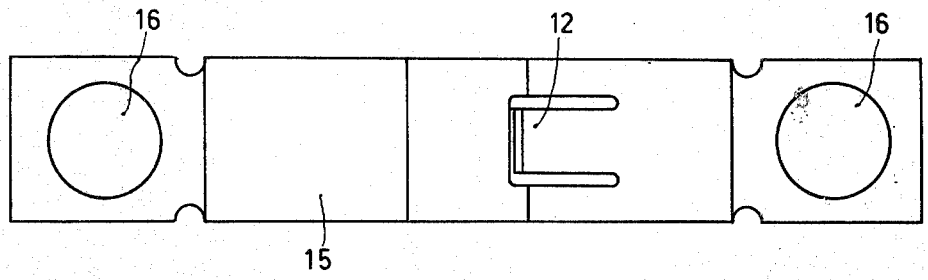
FIG. 4 is a bottom plan view of the strip-shaped component of FIG. 3.

The leaf spring 12 consists of a tab which is formed by a U-shaped slot defining the three sides of the tab, see FIGS. 3 and 4. The tab is integral with and bent slightly out of the plane of the spring section 15 which is made of a thin sheet and which constitutes a lining for the coupling slot 9 and is provided with holes 16 through which the projections 17 of the frame can project. The pressure springs 5 are disposed around said projections at their one side and with their other side they support a hingeable carrying frame 18. The pressure springs 5 are clamped around the projections 17 and also fit tightly in recesses of the carrying frame 18; the assembly which consists of the carrying frame 18, the springs 5 and the cutting block 6, from a unit. This unit is pivotably disposed in the cap 19 to which the shear plate 3 is secured with the aid of the screws 20 and the strips 21 and 22.

The scope of the invention is not limited to the embodiment shown. It also covers embodiments in which a wall of the coupling slot is resiliently movable.

What is claimed is:

1. An electric shaver comprising a housing, a shaving head at the top of said housing, an electric motor mounted in said housing, a drive pin reciprocally driven by said motor, the pin having an end part extending into said shaving head, a thin shear plate having a plurality of hair-entrance apertures mounted in said shaving head, a cutter assembly comprising a frame, a plurality of cutters carried by the frame, the cutters having cutting edges having shape conforming to and engaging said shear plate, said frame further including a coupling slot defining spaced first and second walls for receiving therein said drive end of the drive pin in drive engagement, and connection means in said slot adjacent said first wall of said slot contacting and resiliently urging said drive pin end firmly against said second wall of the slot, said connection means comprising a strip of material conforming generally in shape to and situated in said coupling slot, said strip comprising a spring section adjacent said first wall of the coupling slot, this section including a slot defining a tab bent out of the plane of said section for resiliently engaging said drive end of the drive pin.

2. An electric shaver comprising a housing, a shaving head at the top of said housing, an electric motor mounted in said housing, a drive pin reciprocally driven by said motor, the pin having an end part extending into said shaving head, a thin shear plate having a plurality of hair-entrance apertures mounted in said shaving head, a cutter assembly comprising a frame, a plurality of cutters carried by the frame, the cutters having cutting edges having shape conforming to and engaging said shear plate, said frame further including a coupling slot defining spaced first and second walls for receiving therein said drive end of the drive pin in drive engagement, and connection means in said slot adjacent said first wall of said slot for contacting and resiliently urging said drive pin end firmly against said second wall of the slot, said connection means comprising a leaf spring conforming generally in shape to said slot, the spring having one flat wall against said first wall of the slot, and a resiliently movable wall between said second wall of the slot and an adjacent surface of said drive pin end.

3. An electric shaver comprising a housing, a shaving head at the top of said housing, an electric motor mounted in said housing, a drive pin reciprocally driven by said motor, the pin having an end part extending into said shaving head, a thin shear plate having a plurality of hair-entrance apertures mounted in said shaving head, a cutter assembly comprising a frame, a plurality of cutters carried by the frame, the cutters having cutting edges having shape conforming to and engaging said shear plate, said frame further including a coupling slot defining spaced first and second walls for receiving therein said drive end of the drive pin in drive engagement, and connection means in said slot adjacent said first wall of said slot for contacting and resiliently urging said drive pin end firmly against said second wall of the slot, said connection means comprising a leaf spring made of a strip of material conforming generally in shape to and situated in said coupling slot, said strip comprising a spring section adjacent said first wall of the coupling slot, this section including a slot defining a tab bent out of the plane of the section for resiliently engaging said drive end of the drive pin.

* * * * *

UNITED STATES PATENT AND TRADEMARK OFFICE

CERTIFICATE OF CORRECTION

PATENT NO. : 4003131

DATED : January 18, 1977

INVENTOR(S) : GERRIT JAN GROOTHUIS

It is certified that error appears in the above-identified patent and that said Letters Patent are hereby corrected as shown below:

Column 2, line 46 - change "from" to --form--

Signed and Sealed this

Twelfth Day of April 1977

[SEAL]

*Attest:*

RUTH C. MASON
*Attesting Officer*

C. MARSHALL DANN
*Commissioner of Patents and Trademarks*